US007216870B1

(12) United States Patent
Bess et al.

(10) Patent No.: US 7,216,870 B1
(45) Date of Patent: May 15, 2007

(54) RESOURCE POINT GAME MECHANIC

(75) Inventors: Eric Schreiner Bess, Wildomar, CA (US); Timothy Patrick Shields, Portland, OR (US)

(73) Assignee: Shields Design Studio, LLC, Portland, OR (US)

( * ) Notice: Subject to any disclaimer, the term of this patent is extended or adjusted under 35 U.S.C. 154(b) by 178 days.

(21) Appl. No.: 10/886,804

(22) Filed: Jul. 8, 2004

(51) Int. Cl.
*A63F 1/00* (2006.01)

(52) U.S. Cl. ..... 273/292; 273/308

(58) Field of Classification Search ..... 273/250–299, 273/300–349
See application file for complete search history.

(56) References Cited

U.S. PATENT DOCUMENTS 5,662,332 A 9/1997 Garfield
6,142,475 A 11/2000 Hennessey
6,322,077 B1 11/2001 Braunlich et al.
6,623,010 B1 9/2003 Holland, Jr.

OTHER PUBLICATIONS

Lord of the Rings™ Trading Card Game Comprehensive Rulebook Version 3.0, p. 7, at least as early as Jul. 8, 2004.

*Primary Examiner*—Benjamin Layno
(74) *Attorney, Agent, or Firm*—Law Office of Karen Dana Oster, LLC

(57) ABSTRACT

A resource point game mechanic includes a plurality of game components, at least some of which have a resource point value. Each game component is in a state such as an "in play" state or an "out of play" state. Resource points according to the resource point value are accumulatable by a player transitioning one of the game components from the "out of play" state to the "in play" state. Preferably, the resource points are spendable on benefits/chances/penalties. An alternative preferred embodiment of the present invention is a method for using a game mechanic in which each player obtains a plurality of game components having a resource point value, then each player, in turn, transitions at least one of the game components from an "out of play" state to an "in play" state, and then each player accumulates resource points according to the resource point value by the step of transitioning.

21 Claims, 8 Drawing Sheets

PLAYER #1

PLS = 15

RP = 22

PLAYER #1

PLS = 17

RP = 5

RESOURCE POINT GAME MECHANIC

BACKGROUND OF INVENTION

The present invention is directed to a new game mechanic for a game, and particularly to a new game mechanic in which resource points are accumulated by putting a game component such as a card into play in a game such as a trading card game.

For thousands of years history has recorded that man has been player of both physical and mental games. Ancient civilizations played simple games such as tic-tac-toe. More complicated games were developed as civilization progressed. Board games (e.g. chess and monopoly) and card games (e.g. gin rummy and poker) remain extremely popular. Newer games (e.g. fantasy and role-playing games) have also been developed and become popular. With the advent of computers and the internet, some of these games may now be played virtually "online."

Games are generally made up of one or more physical or virtual game components (e.g. a board, pieces, tokens, dice, or cards), a plurality of rules of play (e.g. how to set up, how to get points, how to move pieces, or how to win), and a plurality of game mechanics. Exemplary low-level game mechanics include rolling dice, spinning a spinner, drawing cards, capturing pieces, and any means for advancing play. High-level game mechanics (hereinafter referred to as "game mechanics") may be more complicated or may include a series of rules (often the core rules) that are used to advance play or define how a game proceeds. For example, MONOPOLY® has the game mechanics of purchasing "properties" as game pieces land on the properties, collecting a "set" of properties, building improvements on sets of properties, and charging "rent" to other players whose game pieces land on the properties. As another example, chess has the game mechanic of moving game pieces in predetermined patterns to capture the other player's game pieces. In football, a game mechanic might be that a team loses possession of the ball after failing to advance 10 yards in 4 downs.

Trading card games exemplify one of the newer types of game genres. In typical trading card games, each player has a deck of trading cards that are compiled from sets of trading cards that are available for purchase. Players purchase, trade, or otherwise acquire trading cards to form a collection of trading cards. Each player selects the cards with which he wishes to play and thereby constructs his deck from the totality of trading cards in his collection. Each player draws an initial "hand" of trading cards by shuffling his deck and drawing a plurality of random trading cards. Each player executes in turn a sequence of actions including, for example, drawing, playing, and discarding trading cards in accordance with the rules of play and using game mechanics until the game ends.

Players of trading card games use the trading cards in their decks in a series of conflicts. Although given different names, there are usually different types of trading cards in the deck including, but not limited to, character cards, enhancing cards (providing energy, resources), and variation cards (providing spells, training, situations, challenges, goals, or other situations). In some cases cards may exhibit traits of one or more of the different types of trading cards. For example, "attachments" may be either an enhancing card or a variation card. The trading cards have different characteristics that make them "valuable" in certain situations. For example, the character cards generally have a cost characteristic (how many enhancing cards it takes to use the character card), an offensive characteristic (how much damage the character card can inflict when it attacks during a conflict), and a defensive characteristic (how much damage the character card can withstand during a conflict). Each player also generally has a separate "player life score" that may be reduced and/or increased based on the results of a conflict or based on the playing of variation cards. The object of the game is generally to be the first to reduce an opponent's player life score to zero (0). Alternative winning conditions (e.g. accumulating a predetermined number of goal cards) are possible.

The original trading card game is MAGIC: THE GATHERING®. The "MAGIC" game begins with each player putting his deck into a library stack and drawing a plurality of trading cards (e.g. seven (7)) from his library stack. MAGIC's trading cards can be divided into three basic categories: character/creature cards, enhancing/land/manna cards, and variation/sorcery cards. Enhancing/land/manna cards provide resources that allow character/creature cards and variation/sorcery cards to be brought into play. To "pay" for putting a character/creature card or a variation/sorcery card into play, you must "tap" (turn sideways) enhancing/land/manna cards that equal the "mana cost" (the cost characteristic) of that character/creature or variation/sorcery that is indicated on the character/creature card or variation/sorcery card. More valuable characters/creatures and variation/sorcery cards usually cost more to bring into play. Each turn, a player "untaps" (turn straight) his tapped trading cards (if any are tapped), draws a trading card from his library stack, and plays one enhancing/land/manna card (if he has any and if he so desires to play the enhancing/land/manna card). If he has enough enhancing/land/manna cards (resources), he may tap the enhancing/land/manna cards and bring character/creature cards into play. After the turn in which a character/creature card is brought into play, it may be tapped to "attack" the opponent in a conflict. The power points (offensive characteristic) and the toughness points (defensive characteristic) of the character/creature cards in play determine the result of an attack. If the result of an attack is that a character/creature "dies," then it is sent to the "graveyard" which is a stack of cards that are out of play. The player may also play one or more variation/sorcery cards in the same turn as he attacks his opponent with one or more character/creature cards. It is significant that the enhancing/land/manna cards provide resources that are used to "pay" to bring character/creature cards and variation/sorcery cards into play and that the game mechanic that is used to show that the trading card is being used is tapping.

YU-GI-OH!™ is a popular trading card game that was inspired by "MAGIC." There are differences between the games such as the terminology, types of cards (e.g. monster, spell, and trap cards), the numbers of points, terminology of the conflict (e.g. attacking an opponent v. dueling/battling with the opponent's character/monster cards), and the use of a side deck. Like "MAGIC," Yu-Gi-Oh! uses cards already in play to provide resources. Character/monster cards can be used as enhancing cards that are used to "pay" to bring character/monster cards and variation/spell cards into play. Yu-Gi-Oh! uses character/monster cards to pay "tribute" to tribute summon (put into play) higher level (the cost characteristic shown on the card by its "level") character/monster cards. Under some circumstances, Yu-Gi-Oh! may also use "equip spell cards" as a type of enhancing card to modify the strength of character/monster cards. Yu-Gi-Oh! also uses a tapping game mechanic to show how the trading card is being used. For example, in Yu-Gi-Oh! the tapping of a character/monster card determines whether it is in attack position or defense position. The attack points (offensive characteristic) and the defense points (defensive characteristic) of the character/monster cards in play determine the result of a conflict.

POKEMON® is another popular trading card game. POKEMON trading cards include character/basic/evolution cards, enhancing/energy cards, and variation/trainer cards. POKEMON uses enhancing/energy cards to provide resources that are used to "pay" for allowing the character/basic/evolution cards to attack. The cost characteristic of a character/basic/evolution card is shown as the attack cost. The attack damage points (offensive characteristic) and the hit points (defensive characteristic) of the character/basic/evolution cards in play determine the result of a conflict. POKEMON uses a tapping game mechanic to show special characteristics applied to character/basic/evolution card. For example, in POKEMON the tapping of a character/basic/evolution card may show that the pokemon is asleep, confused, and/or paralyzed.

BRIEF SUMMARY OF THE INVENTION

The present invention is directed to a new game mechanic for a game, and particularly to a new game mechanic in which resource points are accumulated by putting a game component such as a card into play in a game such as a trading card game.

More specifically, the present invention is directed to a game mechanic for use in a game played by a plurality of players. The game mechanic preferably includes a plurality of game components, at least some of which have a resource point value. Each game component is in a state such as an "in play" state or an "out of play" state. Resource points according to the resource point value are accumulatable by a player transitioning one of the game components from the "out of play" state to the "in play" state. Preferably the resource points are spendable on benefits/chances/penalties. In one preferred embodiment of the game, additional resource points may be earned and accumulated in alternate manners such as based on the number of game components in the player's possession at the end of his turn.

Another preferred embodiment of the present invention is a method for using a game mechanic in a game played by a plurality of players. The method includes the first step of each player obtaining a plurality of game components to form an initial hand, where at least some of the game components have a resource point value. Then, each player, in turn, transitions at least one of the game components from an "out of play" state to an "in play" state. Finally, each player accumulates resource points according to the resource point value by the step of transitioning. In one preferred embodiment of this method, resource points may be spent. The present invention may also include additional steps such as conducting game play or receiving predetermined resource point(s) for every game component in player's possession at end of turn.

The foregoing and other objectives, features, and advantages of the invention will be more readily understood upon consideration of the following detailed description of the invention, taken in conjunction with the accompanying drawings.

DETAILED DESCRIPTION OF THE INVENTION

The present invention is directed to a game mechanic for use in a game played by a plurality of players. The game mechanic includes a plurality of game components each having a resource point value (RPV). Each game component may be either an "in play" state or an "out of play" state. Resource points (RP) according to the resource point value are accumulatable by a player transitioning a game component from the "out of play" state to the "in play" state. Resource points are preferably spendable. The present invention also is directed to a method (shown in a simplistic form in FIG. 1) for using the game mechanic in a game such as a trading card game. In a way, the resource points add a real-life level of strategy to known games and games yet to be developed.

Figure 2:
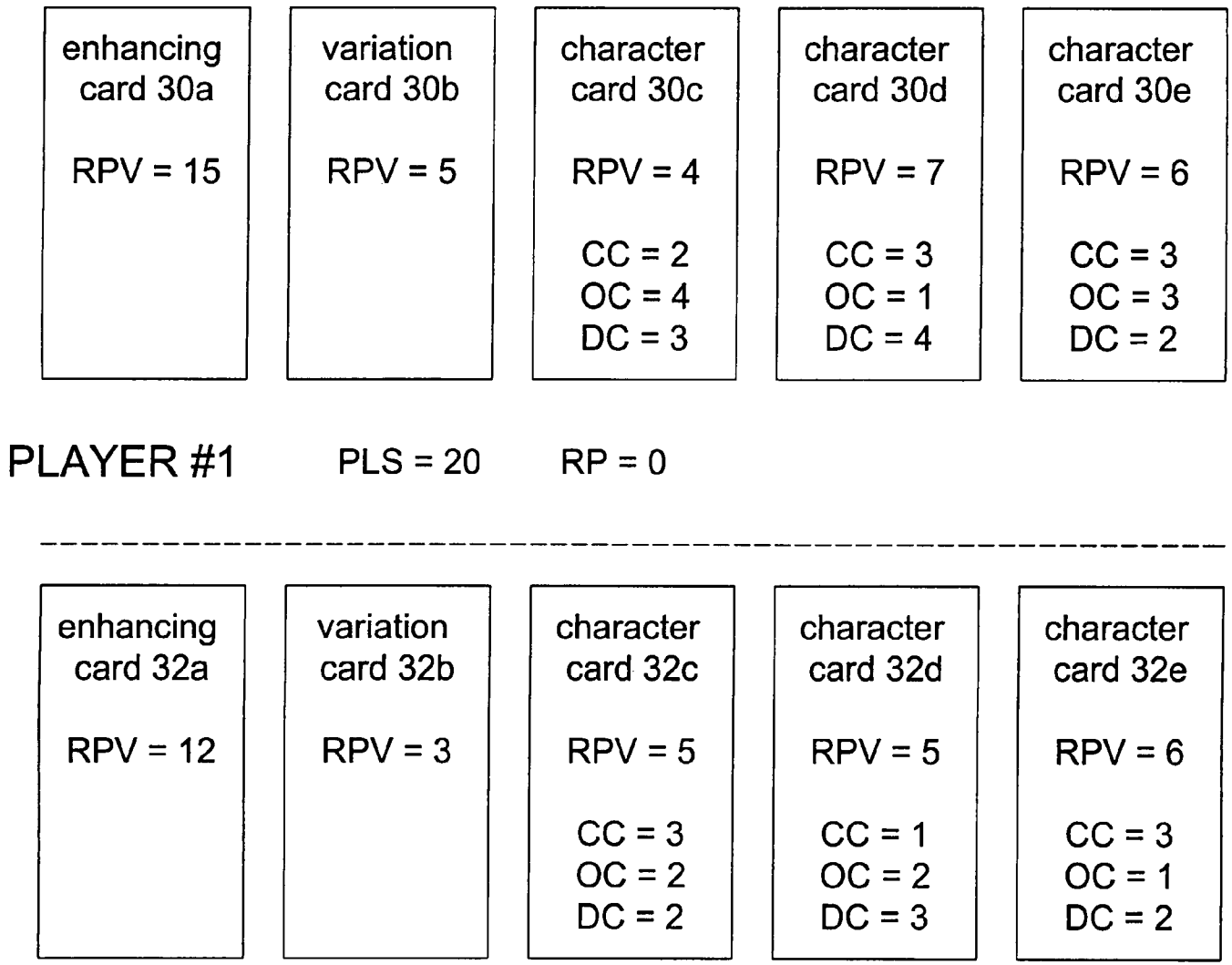
FIG. 2 shows the game components and scores of player #1's initial playing hand and the game components and scores of player #1's initial playing hand.

Trading card games will be used for the purpose of describing the present invention. As with typical trading card games, each player would use the trading cards (e.g. character cards, enhancing cards, and variation cards) in his deck in a series of conflicts. For purposes of example only, as shown in FIG. 2, the character cards would have a cost characteristic (CC), an offensive characteristic (OC), and a defensive characteristic (DC). (More, less, and/or alternative characteristics may be used, depending on the game in which the present invention is used.) For exemplary purposes, each player would have a separate "player life score" (PLS) that may be reduced and/or increased based on the results of a conflict or based on the playing of variation cards. An exemplary object of the game would be to be the first to reduce an opponent's player life score to zero (0). It should be noted that although the present invention may be played with trading cards, it is possible to use alternative embodiments including virtual trading cards, tokens, customized dice, action figures, or board game pieces (hereinafter referred to jointly as "game components").

Each player obtains a plurality of trading cards (game components) to form an initial hand. At least some of the trading cards have a resource point value (RPV). One way that a player may obtain the trading cards is to draw from a deck (which may be pre-constructed from trading cards in his collection). Specifically, each player may draw an initial "hand" of trading cards by shuffling his deck and drawing a plurality of random trading cards. Although in one preferred embodiment of the present invention all of the trading cards (e.g. character cards, enhancing cards, and variation cards) have a resource point value, alternative embodiments could have trading cards without a resource point value or with a resource point value of zero (0). For example, certain individual cards may not have a resource point value or may have a "0" resource point value, cards having certain characteristics (e.g. high or low values or characteristics) may not have a resource point value or may have a "0" resource point value, and/or a certain type of card (e.g. the enhancing cards) does not have a resource point value at all or has a "0" resource point value.

The players then take turns executing a sequence of actions including, for example, drawing, playing, and discarding trading cards in accordance with the rules of play (and often using game mechanics to advance play) until the game ends.

In one preferred embodiment, each trading card is either in an "in play" state or an "out of play" state. Depending on the rules, however, alternative embodiments of the invention could include some trading cards that are neither "in play" nor "out of play," but may have alternative game component states such as "retired" state, "sleep" state, "set aside" state, no state (e.g. limbo), "stand by" state, "reserve" state, or other alternative states. For example, a variation card may not have any state.

As part of his turn, a player may transition at least one of the trading cards from an "out of play" state to an "in play" state. For example, the player may initially transition (play) a trading card from his initial hand ("out of play" state) to the playing field ("in play" state). In alternative embodiments, other transitions may include a transition from an alternate state (e.g. a "retired" state or a "sleep" state). One exemplary alternative transition could be removing a trading card from a graveyard ("retired" state") and putting it into a player's hand ("out of play" state). Another alternative transition could be bringing a character out of a "sleep" state and returning it to the playing field ("in play" state). Depending on the specifics of the rules and/or game mechanic, the player may accumulate resource points according to the resource point value by these alternative steps of transitioning. Depending on the specifics of the rules and/or game mechanic, another alternative embodiment of the present invention could allow only certain types of transitions (e.g. an initial playing of a trading card from the initial hand to the playing field) to accumulate resource points.

In one preferred embodiment of the present invention, resource points may be earned in additional ways. For example, at the end of each turn, a player may accumulate one resource point (or any other predetermined number) for each trading card he has in his hand. Since playing a trading card will remove it from the player's hand, the player must balance/strategize whether the impact of the trading card on the game (and the resource points he accumulates by playing the trading card) has a strategic advantage compared with the resource points he can receive by not playing the trading card. As an example, a relatively weak card having low offensive and defensive characteristics may have a high resource point value. Putting the relatively weak card in the "in play" state would allow the player to accumulate resource points equal to the resource point value, but the card would not be very strong in a conflict. On the other hand, by keeping the card in his hand in the "out of play" state, the player can accumulate a resource point each turn. An alternative way to earn additional resource points could be based on the number of cards in your opponent's hand, the time it takes to complete your turn, or any other means specified in the game rules.

Resource points are preferably spendable on a benefit/chance/penalty. For example, a player could spend a predetermined number of resource points (e.g. ten (10) points) to draw additional trading cards into his hand. Additional ways in which a player may spend resource points on a benefit/chance/penalty include, but are not limited to using card effects, paying for additional player life score points, affecting other trading cards (e.g. enhancing character cards), and any other way that is predetermined by the rules of play.

Figure 1:
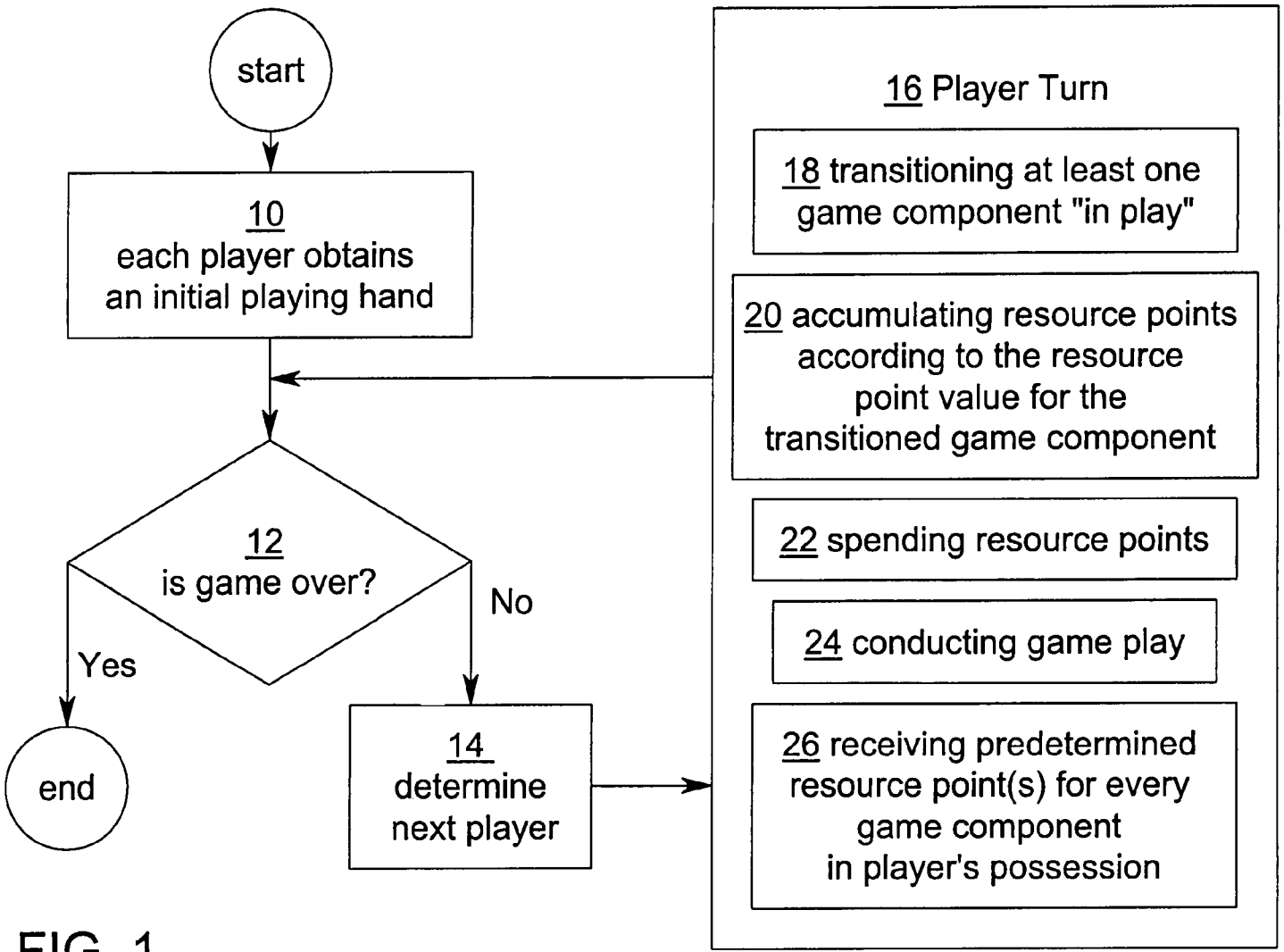
FIG. 1 is a simplified flow chart of an exemplary embodiment of a game flow of the present invention.

FIG. 1 shows an exemplary, simplified game flow method using the present invention. As shown, the game starts with each player obtaining an initial hand 10. Assuming the game isn't immediately over 12, the next player is determined 14, and the first player takes his turn 16. Depending on the rules of the game, during a player's turn, the player may do one or more of the following: transitioning at least one game component to an "in play" state 18; accumulating resource points according to the resource point value for the transitioned game component 20; spending resource points 22 (e.g. drawing cards); conducting game play 24 (e.g. entering into a conflict and/or playing one or more cards according to the rules of the game); and/or receiving predetermined resource point(s) for every game component in player's possession (generally at the end of the player's turn, but alternatively at the beginning of the turn or at a predetermined time of the turn) 26. Depending on the rules of the game, a player may be allowed to perform these steps in any order, perform one or more of these steps multiple times, and/or choose not to perform one or more of these steps for a particular turn. If the game has not ended 12, the next player is determined 14, and the next player takes his turn 16.

Exemplary Games

FIGS. 2–6 show a simplified, beginning of a trading card game that uses the present invention.

First, each player obtains a plurality (shown as five (5)) of trading cards (game components) to form an initial hand. FIG. 2 shows the initial hand of Player #1 (with game components 30*a*–30*e*) and the initial hand of Player #2 (with game components 32*a*–32*e*). It should be understood that the initial hands would most likely be kept secret from the other players.

The players then take turns executing a sequence of actions including, for example, drawing, playing, and discarding trading cards in accordance with the rules of play (and often using game mechanics to advance play) until the game ends. It should be noted that alternative rules within the scope of the invention could allow for turns to be skipped.

Figure 3:
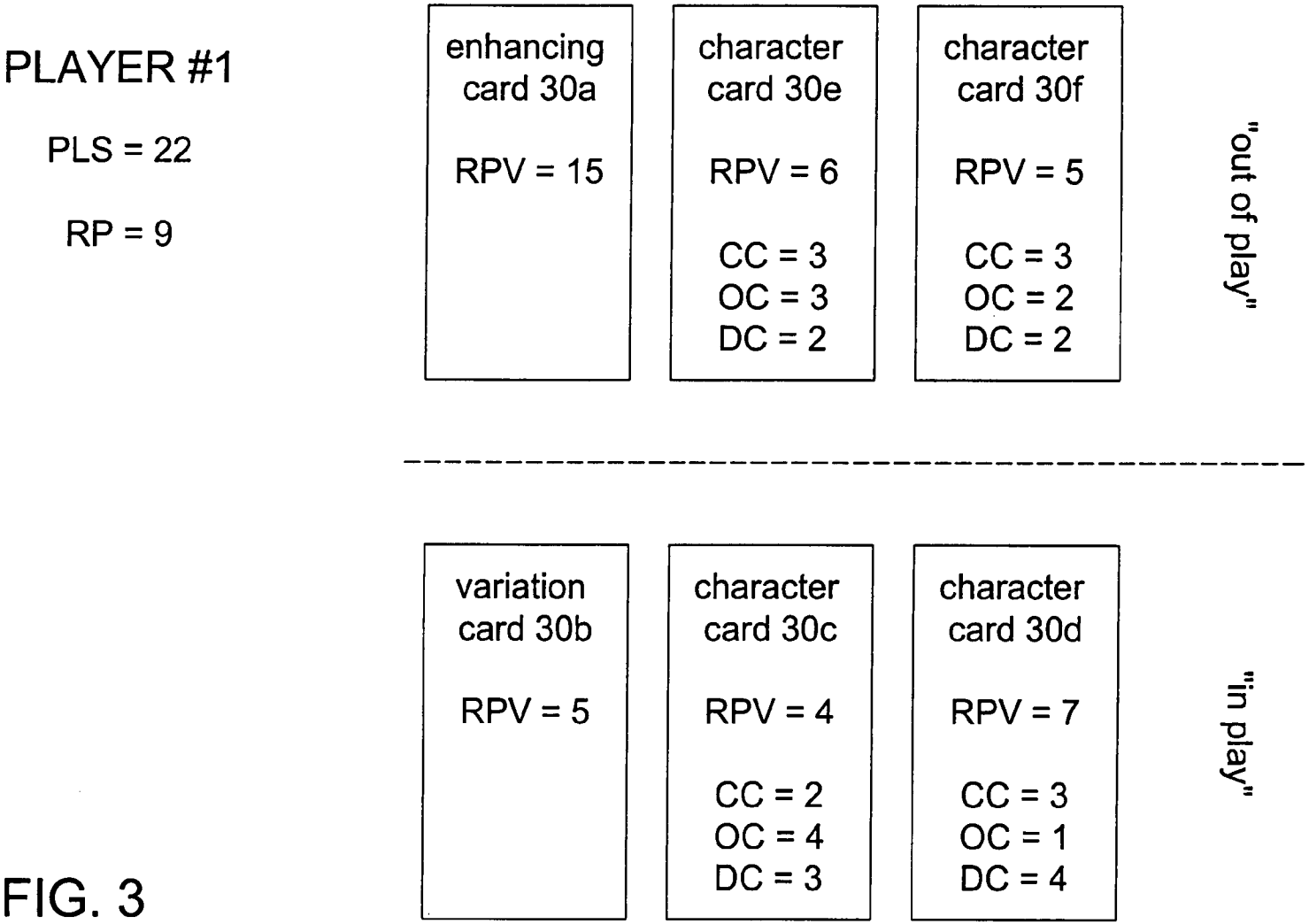
FIG. 3 shows game components in the "in play" state and the "out of play" state as well as the scores for player #1 after his first turn.

FIG. 3 shows the game components that are in the "in play" state and the "out of play" state as well as the scores for player #1 after his first turn. In this turn, player #1 transitions (plays) three game components 30*b*, 30*c*, and 30*d* from "out of play" to "in play." As part of the game mechanic, player #1 accumulates resource points according to the resource point value by this step of transitioning. Specifically, player #1 would accumulate 16 resource points because game component 30*b* has a resource point value of 5, game component 30*c* has a resource point value of 4, and game component 30*d* has a resource point value of 7. Player #1 then spends 10 of his 16 resource points to draw game component 30*f*. This leaves player #1 with 6 resource points. As a result of conducting game play, player #1 has a player life score of 22 and player #2 has a player life score of 18 (not shown). Finally, at the end of his turn, player #1 receives one (1) resource point for each of the three (3) game components in his possession to increase his resource points from 6 to 9 (as shown). This is the end of this turn for player #1.

Figure 4:
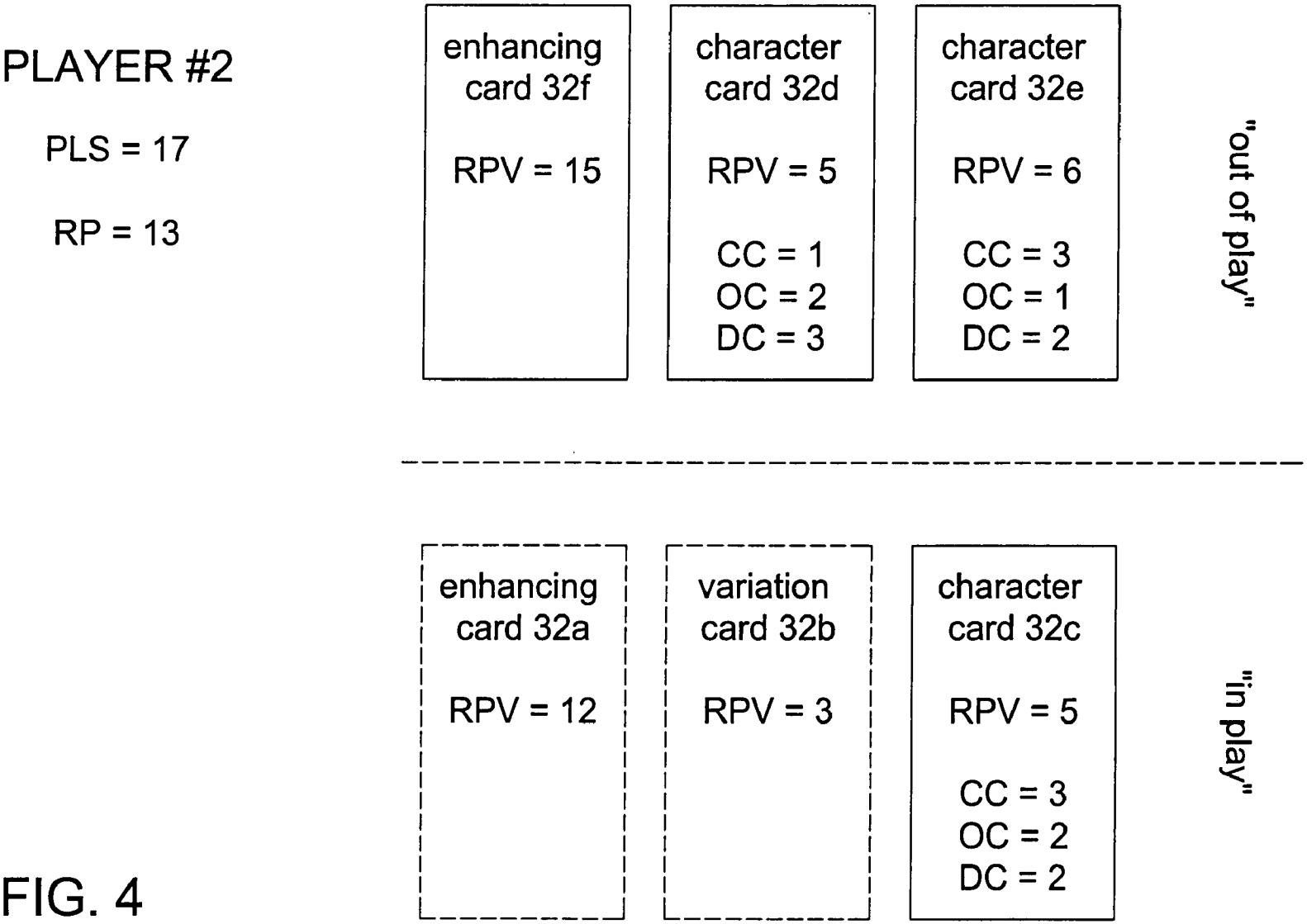
FIG. 4 shows game components in the "in play" state and the "out of play" state as well as the scores for player #2 after his first turn.

FIG. 4 shows the game components that are in the "in play" state and the "out of play" state as well as the scores for player #2 after his first turn. In this turn, player #2 transitions (plays) three game components 32*a*, 32*b*, and 30*c* from "out of play" to "in play." As part of the game mechanic, player #2 accumulates resource points according to the resource point value by this step of transitioning. Specifically, player #2 would accumulate 20 resource points because game component 32*a* has a resource point value of 12, game component 32*b* has a resource point value of 3, and game component 32*c* has a resource point value of 5. Player #2 then spends 10 of his 20 resource points to draw game component 32*f*. This leaves player #2 with 10 resource points. As a result of conducting game play, player #2 has a player life score of 17 and player #1 has a player life score of 18 (not shown). Player #2 also loses/retires two game components 32*a* and 32*b* (shown in phantom) and player #1 loses/retires two game components 30*c* and 30*d*. Finally, at the end of his turn, player #2 receives one (1) resource point for each of the three (3) game components in his possession to increase his resource points from 10 to 13 (as shown). This is the end of this turn for player #2.

Figure 5:
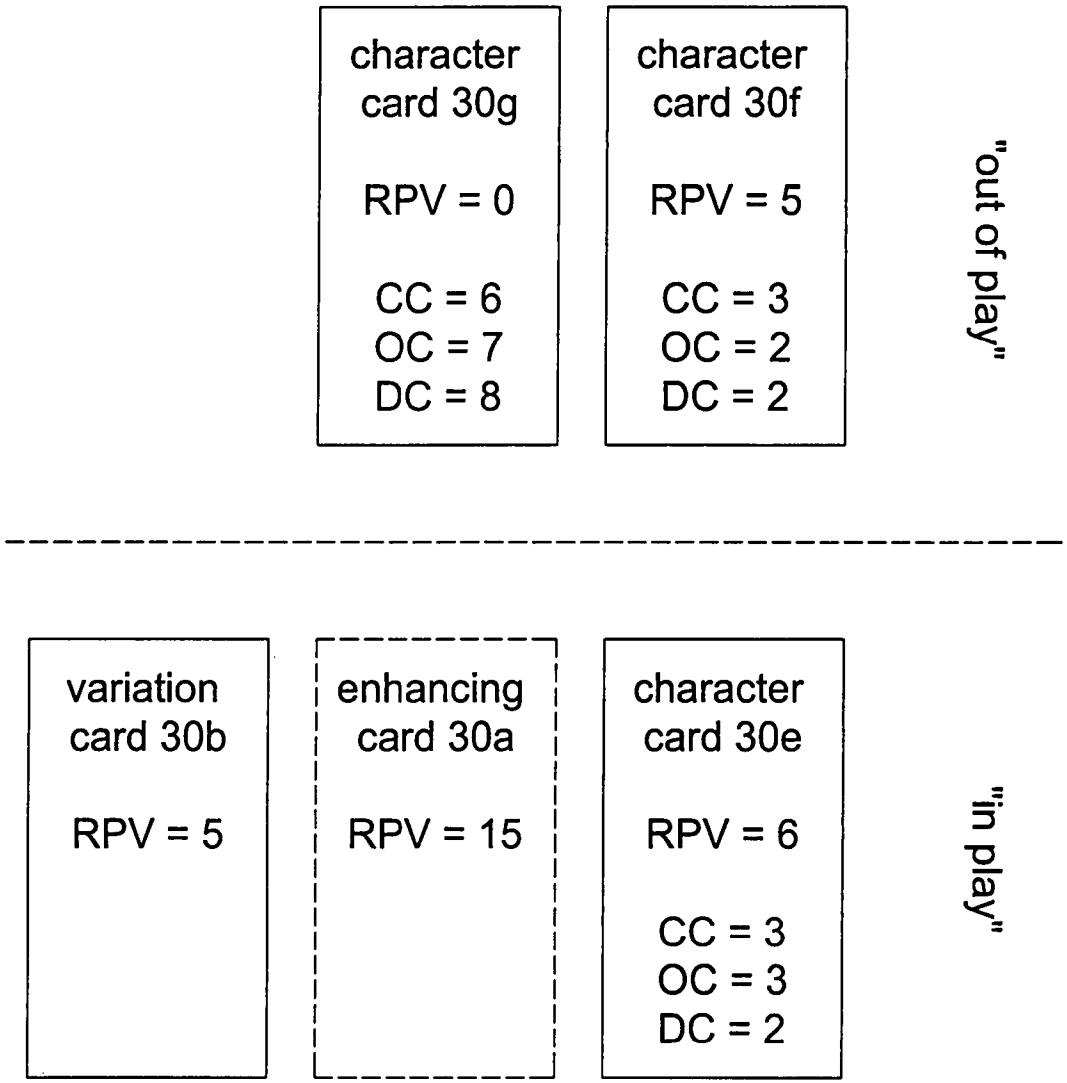
FIG. 5 shows game components in the "in play" state and the "out of play" state as well as the scores for player #1 after his second turn.

FIG. 5 shows the game components that are in the "in play" state and the "out of play" state as well as the scores for player #1 after his second turn. At the start of his turn, player #1 has 9 resource points and a player life score of 18. Player #1 first transitions (plays) two game components 30*a* and 30*e* from "out of play" to "in play." As part of the game mechanic, player #1 accumulates resource points according to the resource point value by this step of transitioning. Specifically, player #1 would accumulate 21 resource points (for a total of 30 resource points) because game component 30*a* has a resource point value of 15 and game component 30*e* has a resource point value of 6. Player #1 then spends 10 of his 30 resource points to draw game component 30*g* (a powerful card, but having a low resource point value). This leaves player #1 with 20 resource points. As a result of conducting game play, player #1 has a player life score of 15 and player #2 has a player life score of 13 (not shown). Player #1 also loses/retires his game component 30*a* (shown in phantom). Finally, at the end of his turn, player #1 receives one (1) resource point for each of the two (2) game components in his possession to increase his resource points from 20 to 22 (as shown). This is the end of this turn for player #1.

Figure 6:
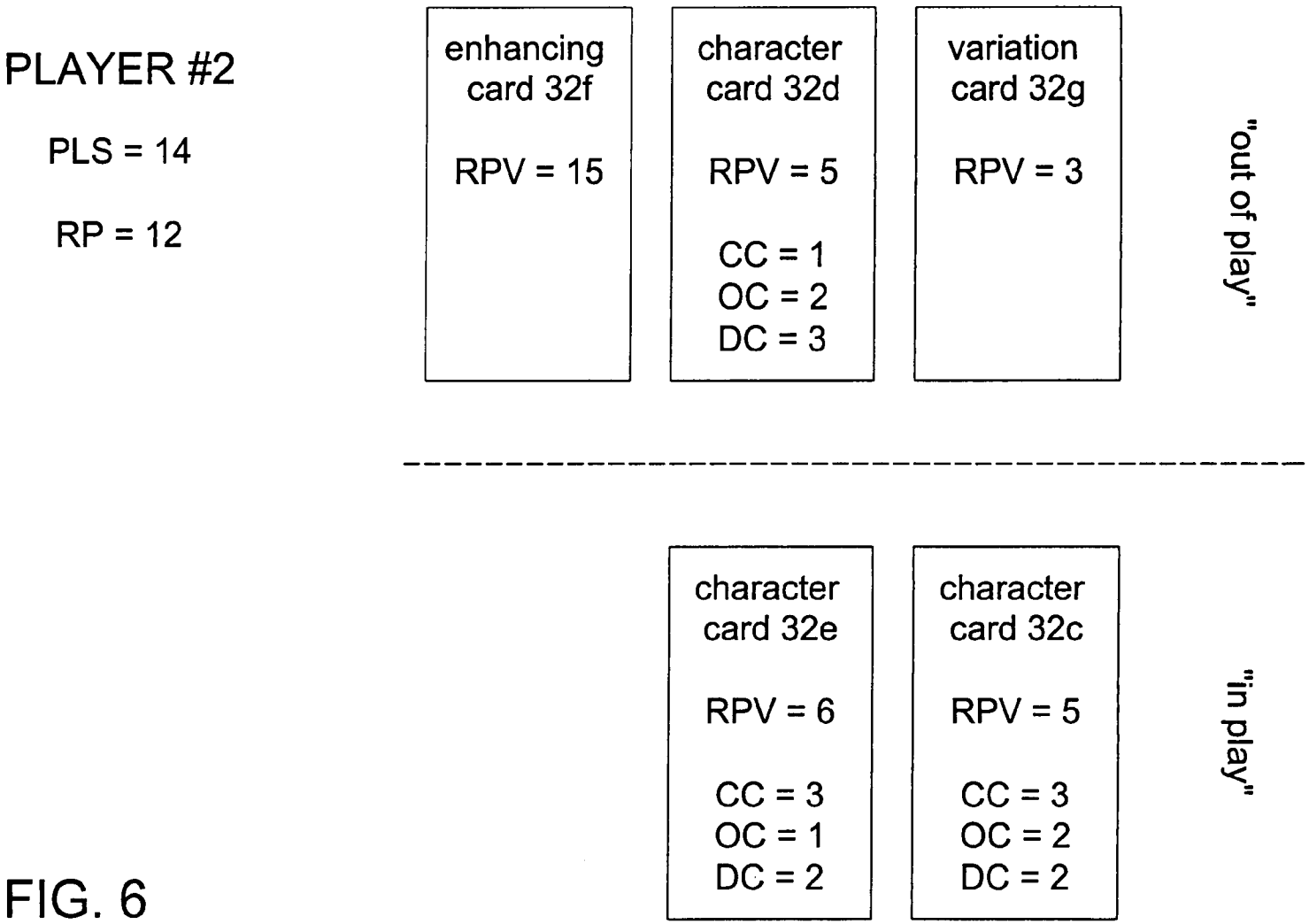
FIG. 6 shows game components in the "in play" state and the "out of play" state as well as the scores for player #2 after his second turn.

FIG. 6 shows the game components that are in the "in play" state and the "out of play" state as well as the scores for player #2 after his second turn. At the start of his turn, player #2 has 13 resource points and a player life score of 13. Player #2 first transitions (plays) one game component 32*e* from "out of play" to "in play." As part of the game mechanic, player #2 accumulates resource points according to the resource point value by this step of transitioning. Specifically, player #2 would accumulate 6 resource points (for a total of 19 resource points) because game component 32*e* has a resource point value of 6. Player #2 then spends 10 of his 19 resource points to draw game component 32*g*. This leaves player #2 with 9 resource points. As a result of conducting game play, player #2 has a player life score of 14 and player #1 has a player life score of 13 (not shown). Finally, at the end of his turn, player #2 receives one (1) resource point for each of the three (3) game components in his possession to increase his resource points from 9 to 12 (as shown). This is the end of this turn for player #2.

Figure 7:
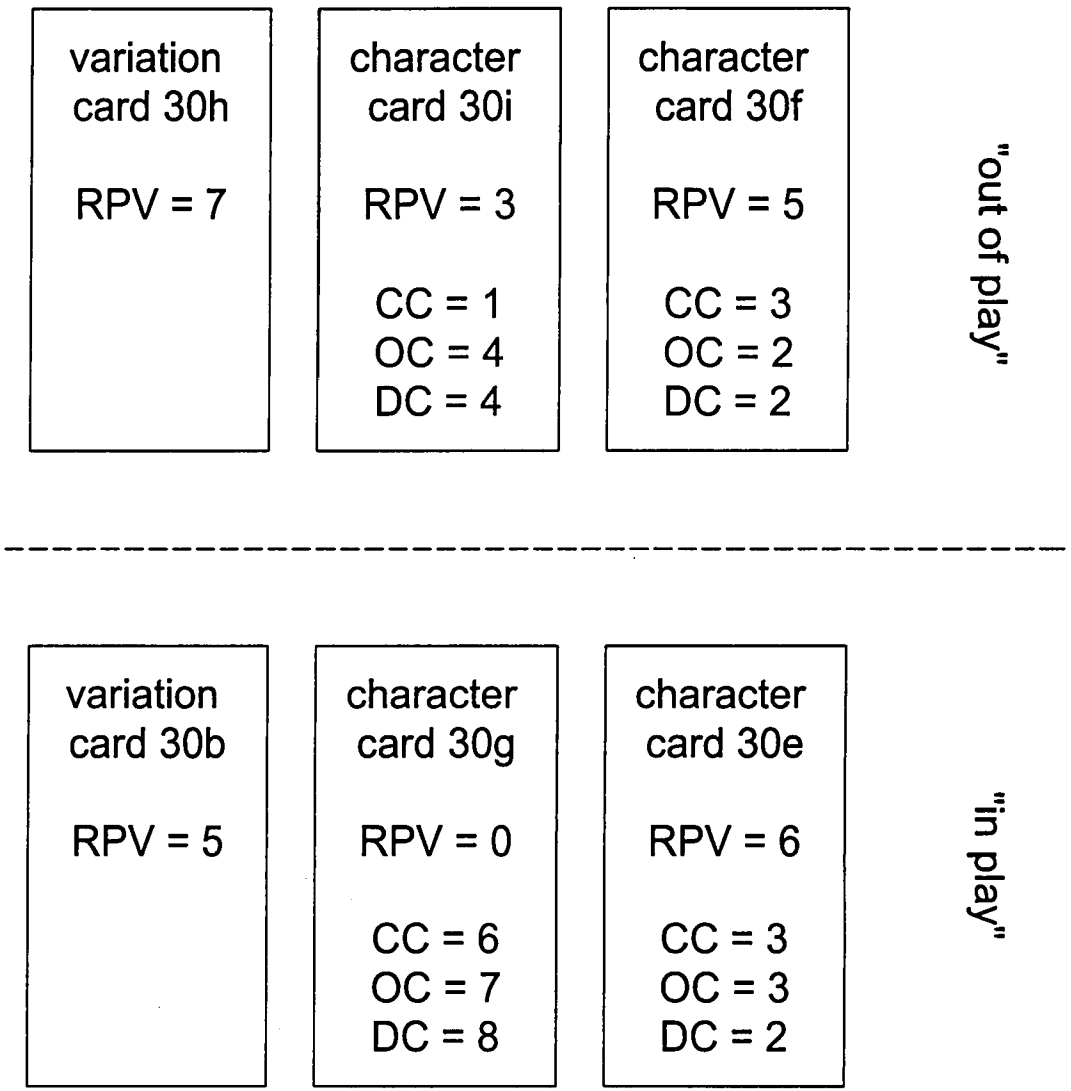
FIG. 7 shows game components in the "in play" state and the "out of play" state as well as the scores for player #1 after his third turn.

FIG. 7 shows the game components that are in the "in play" state and the "out of play" state as well as the scores for player #1 after his third turn. At the start of his turn, player #1 has 22 resource points and a player life score of 13. Player #1 first transitions (plays) one game component 30*g* from "out of play" to "in play." As part of the game mechanic, player #1 accumulates resource points according to the resource point value by this step of transitioning. However, because game component 30*g* has 0 resource point value, player #1 would not accumulate any resource points (and his total would remain 22 resource points). Player #1 then spends 20 of his 22 resource points to draw game component 30*h* and game component 30*i*. This leaves player #1 with 2 resource points. As a result of conducting game play, player #1 has a player life score of 17 and player #2 has a player life score of 10 (not shown). Player #2 also loses/retires his game components 32*c* and 32*e*. Finally, at the end of his turn, player #1 receives one (1) resource point for each of the three (3) game components in his possession to increase his resource points from 2 to 5 (as shown). This is the end of this turn for player #1.

Figure 8:
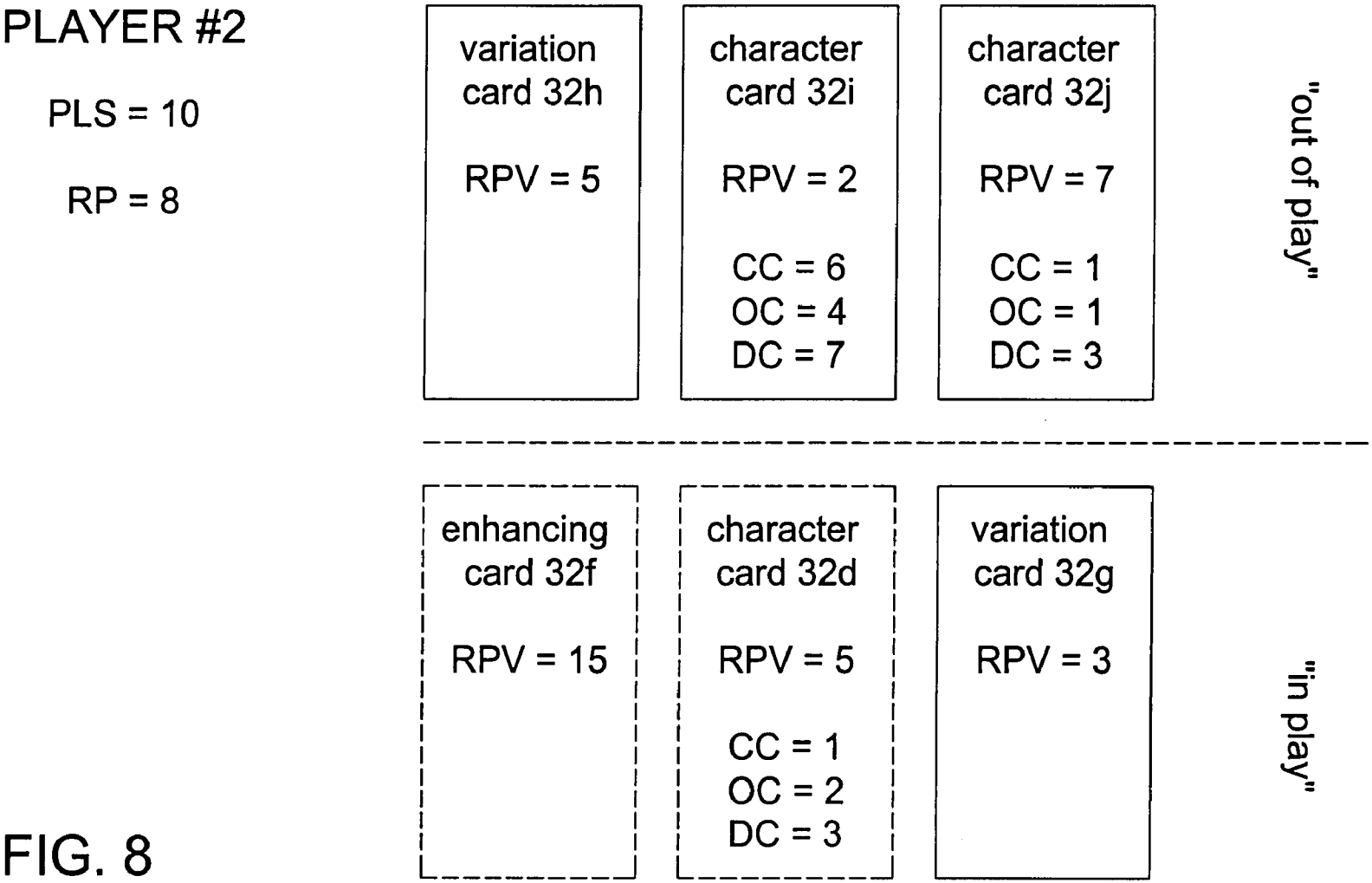
FIG. 8 shows game components in the "in play" state and the "out of play" state as well as the scores for player #2 after his third turn.

FIG. 8 shows the game components that are in the "in play" state and the "out of play" state as well as the scores for player #2 after his third turn. At the start of his turn, player #2 has 12 resource points and a player life score of 10. Player #2 first transitions (plays) all three of his remaining game components from "out of play" to "in play." As part of the game mechanic, player #2 accumulates resource points according to the resource point value by this step of transitioning. Specifically, player #2 would accumulate 23 resource points (for a total of 35 resource points) because game component 32*f* has a resource point value of 15, component 32*d* has a resource point value of 5, and component 32*g* has a resource point value of 3. Player #2 then spends 30 of his 35 resource points to draw game components 32*h*, 32*i*, and 32*j*. This leaves player #2 with 5 resource points. As a result of conducting game play, player #2 has a player life score of 10 and player #1 has a player life score of 16 (not shown). Player #2 also loses/retires two game components 32*f* and 32*d* (shown in phantom) and player #1 loses/retires two game components 30*b* and 30*e*. Finally, at the end of his turn, player #2 receives one (1) resource point for each of the three (3) game components in his possession to increase his resource points from 5 to 8 (as shown). This is the end of this turn for player #2.

The attached appendices (Appendix A–C) describe additional exemplary trading card games that use the game mechanic of the present invention. It should be noted that these exemplary trading games are meant for the purpose of providing examples, furthering understanding of the invention, and enablement, but are not meant to limit the scope of the invention.

Discussion of Distinctions of Known Games

Known trading card games (e.g. MAGIC: THE GATHERING®, YU-GI-OH™, and POKEMON®) do not include any type of separate accumulatable resource point value. The concept of enhancing cards that, for example, provide energy or resources to put a character card into play is distinct from the concept of resource points of the present invention. Specifically, unlike enhancing cards that are used to "pay" to put a character card into play, resource points are accumulated/gained by putting a game component into play. Some trading cards have a "card effect" in which a point from the player's life score is exchanged for the privilege of drawing a card. This type of card effect is not a rule of play or a game mechanic, but an individual instance associated with a specific card. In addition, the known card effects affect the player's life score, not a unique set of resource points. It should be noted that the concept of resource points of the present invention may be used alone or in combination with the concept of enhancing cards and/or card effects.

Probably the closest concept to resource points is the concept of money used in games such as MONOPOLY® in that, like money, resources can be accumulated and spent. However, in MONOPOLY® there is no concept of an "in play" state or an "out of play" state. Accordingly, money cannot be accumulated as a player transitions one of his game components from the "out of play" state to the "in play" state.

The LORD OF THE RINGS™ trading card game is another popular trading card game. The LORD OF THE RINGS™ trading card game uses its own unique terminology, types of cards (e.g. character/fellowship/minion and variation/possession/event cards), and terminology of the conflict (e.g. attacking an opponent v. the twilight step). The LORD OF THE RINGS™ trading card game does include, however, character/fellowship cards that have an additional cost that one might be misled to believe is similar to the present invention. When a player puts a character/fellowship card into play, he places a number of tokens into the "Twilight pool." During the opponent's portion of that turn, the tokens may be spent by the opponent to bring his character/minion cards into play. Tokens not spent during a given turn are removed as the "Twilight pool" is emptied every turn. In other words, the token resources do not accumulate. Further, it is not the player who receives the benefit of the tokens, but character/minion cards into play the opponent. Finally, the tokens have a very limited purpose (to bring character/minion cards into play) which is significantly different from the spendable resource points of the present invention.

The terms and expressions that have been employed in the foregoing specification are used as terms of description and not of limitation, and are not intended to exclude equivalents of the features shown and described or portions of them. The scope of the invention is defined and limited only by the claims that follow.

What is claimed is:

1. A game mechanic method for playing a game played by a plurality of players on a playing field, said game mechanic method comprising the steps of:

(a) at least one player obtaining a plurality of game components to form a playing hand of game components, each game component having a resource point value, and each game component being either in an "in play" state wherein the game component is placed on the playing field or an "out of play" state wherein the game component is in a player's playing hand and not on the playing field;

(b) at least one player transitioning one of said obtained game components from said "out of play" state to said "in play" state;

(c) at least one player earning resource points according to said resource point value of said selected game component by transitioning said selected game components from said "out of play" state to said "in play" state; and (d) accumulating resource points earned each time said step of earning resource points is performed.

2. The game mechanic method of claim 1, wherein said step of obtaining a plurality of game components further comprises the step of obtaining a plurality of trading cards.

3. The game mechanic method of claim 1, further comprising the step of at least one player obtaining additional game components not having a resource point value.

4. The game mechanic method of claim 1, wherein said step of obtaining a plurality of game components further comprises the step of obtaining a plurality of game components having an alternate state.

5. The game mechanic method of claim 4, further comprising the steps of:

(a) at least one player transitioning one of said game components between said "out of play" state, said "in play" state, and/or said alternate state;

(b) at least one player earning resource points for transitioning one of said game components between said "out of play" state, said "in play" state, and/or said alternate state; and (c) at least one player accumulating said resource points earned for transitioning one of said game components between said "out of play" state, said "in play" state, and/or said alternate state.

6. The game mechanic method of claim 1, further comprising the step of at least one player spending said resource points.

7. The game mechanic method of claim 6, wherein said step of spending said resource points further comprises the step of spending said resource points on a benefit/chance/penalty selected from the group consisting of:

(a) at least one player drawing additional trading cards;

(b) at least one player using card effects;

(c) at least one player paying for additional player life score points; and (d) at least one player affecting other trading cards.

8. The game mechanic method of claim 1, further comprising the steps of at least one player earning resource points based on the number of game components in said player's playing hand at the end of his turn and at least one player accumulating said resource points.

9. The game mechanic method of claim 1, wherein said step of accumulating resource points is implemented over a series of player turns.

10. A method for using a game mechanic in a game played by a plurality of players on a playing field, said method comprising the steps of:

(a) each player obtaining a plurality of game components to form an initial playing hand, at least some game components having a resource point value;

(b) each player, in turn, transitioning at least one of said game components from an "out of play" state wherein the game component is in a player's playing hand and not on the playing field to an "in play" state wherein the game component is placed on the playing field;

(c) each player earning resource points according to said resource point value of a selected game component by said transitioning said selected game component from said "out of play" state to said "in play" state; and (d) each player accumulating said resource points earned each time said step of earning resource points is performed.

11. The method of claim 10, further comprising the step of each player spending resource points.

12. The method of claim 10, further comprising the step of each player conducting game play.

13. The method of claim 10, further comprising the step of each player receiving predetermined resource point(s) for every game component in each player's playing hand at the end of his turn and the step of each player accumulating said resource points.

14. The method of claim 10, wherein said step of each player accumulating said resource points earned is implemented over a series of player turns.

15. A game mechanic method for use in a game played by a plurality of players on a playing field, said game mechanic method comprising the steps of:

(a) each slayer having a plurality of game components, at least two of said plurality of game components having a resource point value, at least two of said plurality of game components having at least two game component states including an "in play" state wherein the game component is placed on the playing field and either and "out of play" state wherein the game component is in a player's playing hand and not on the playing field or at least one alternate game component state (b) a player transitioning at least one of said game components from one of said alternative game component states to said "in play" state;

(c) said slayer earning resource points according to said resource point value of a selected game component by transitioning said selected said game component from one of said alternative game component states to said "in play" state; and (d) said player accumulating earned resource points each time said step of earning resource points is performed.

16. The game mechanic method of claim 15, wherein said plurality of game components are trading cards.

17. The game mechanic method of claim 15, further comprising additional game components not having a resource point value.

18. The game mechanic method of claim 15, further comprising the step of said player spending said resource points.

19. The game mechanic method of claim 18, wherein said step of said player spending said resource points further comprising the step of said player spending said resource points on a benefit/chance/penalty selected from the group consisting of:

(a) said player drawing additional trading cards;

(b) said player using card effects;

(c) said player paying for additional player life score points; and (d) said player affecting other trading cards.

20. The game mechanic method of claim 15, further comprising the steps of said player earning resource points based on the number of game components in said player's playing hand at the end of his turn and said player accumulating said resource points.

21. The game mechanic method of claim 15, wherein said step of said player accumulating earned resource points is implemented over a series of player turns.

* * * * *

UNITED STATES PATENT AND TRADEMARK OFFICE

CERTIFICATE OF CORRECTION

PATENT NO. : 7,216,870 B1
APPLICATION NO. : 10/886804
DATED : May 15, 2007
INVENTOR(S) : Eric Schreiner Bess and Timothy Patrick Shields It is certified that error appears in the above-identified patent and that said Letters Patent is hereby corrected as shown below:

Column 8,
Line 59, delete "YU-GI-OH™" and insert --YU-GI-OH!™--.

Column 11,
Line 10, in Claim 15, after "each" delete "slayer" and insert --player--.
Line 16, in Claim 15, after "either" delete "and" and insert --an--.
Line 19, in Claim 15, after "state" insert --;--.
Line 23, in Claim 15, after "said" delete "slayer" and insert --player--.
Line 25, in Claim 15, after "selected" delete "said".

Signed and Sealed this

Tenth Day of June, 2008

JON W. DUDAS
*Director of the United States Patent and Trademark Office*